US005908073A

United States Patent [19]

Nguyen et al.

[11] Patent Number: 5,908,073

[45] Date of Patent: Jun. 1, 1999

[54] PREVENTING WELL FRACTURE PROPPANT FLOW-BACK

[75] Inventors: Philip D. Nguyen; Kirk L. Schreiner, both of Duncan, Okla.

[73] Assignee: Halliburton Energy Services, Inc., Duncan, Okla.

[21] Appl. No.: 08/883,510

[22] Filed: Jun. 26, 1997

[51] Int. Cl.[6] ..... E21B 43/02

[52] U.S. Cl. ..... 166/276; 166/278; 166/280; 166/308

[58] Field of Search ..... 166/276, 278, 166/280, 308

[56] References Cited

U.S. PATENT DOCUMENTS

| | | | |
|---|---|---|---|
| 3,888,311 | 6/1975 | Cooke | 166/280 |
| 4,524,101 | 6/1985 | Eickman et al. | 428/294 |
| 4,524,158 | 6/1985 | Barber | 523/130 |
| 4,811,908 | 3/1989 | Galati | 241/21 |
| 5,226,481 | 7/1993 | Le et al. | 166/300 |
| 5,330,005 | 7/1994 | Card et al. | 166/280 |
| 5,358,047 | 10/1994 | Himes et al. | 166/280 |
| 5,439,055 | 8/1995 | Card et al. | 166/280 |
| 5,501,274 | 3/1996 | Nguyen et al. | 166/280 X |
| 5,501,275 | 3/1996 | Card et al. | 166/280 |

*Primary Examiner*—Roger Schoeppel
*Attorney, Agent, or Firm*—Robert A. Kent; Clark Dougherty, Jr.

[57] ABSTRACT

Improved methods of propping a fracture in a subterranean zone whereby the subsequent flow-back of the proppant is prevented are provided. The methods basically include the steps of placing a mixture of fibrous bundles and the proppant in the fracture while maintaining the fracture open and then allowing the fracture to close on the mixture of fibrous bundles and proppant.

20 Claims, 1 Drawing Sheet

PREVENTING WELL FRACTURE PROPPANT FLOW-BACK

BACKGROUND OF THE INVENTION

1. Field of the Invention

The present invention relates generally to improved methods of preventing well fracture proppant flow-back, and more particularly, to improved methods of fracturing a subterranean zone and propping the fractures whereby proppant flow-back from the fractures is prevented.

2. Description of the Prior Art

Oil and gas wells are often stimulated by hydraulically fracturing subterranean producing zones penetrated thereby. In such hydraulic fracturing treatments, a viscous fracturing fluid is pumped into the zone to be fractured at a rate and pressure such that one or more fractures are formed and extended in the zone. A solid particulate material for propping the fractures open, referred to herein as "proppant," is suspended in a portion of the fracturing fluid so that the proppant is deposited in the fractures when the viscous fracturing fluid is caused to revert to a thin fluid and returned to the surface. The proppant functions to prevent the fractures from closing whereby conductive channels are formed through which produced fluids can readily flow.

In order to prevent the subsequent flow-back of the proppant as well as subterranean formation particulate solids with fluids produced from the fractured zone, at least a portion of the proppant has heretofore been coated with a hardenable resin composition and consolidated into a hard permeable mass. Typically, the resin composition coated proppant is deposited in the fractures after a larger quantity of uncoated proppant material has been deposited therein. That is, the last portion of the proppant deposited in each fracture, referred to in the art as the "tail-in" portion, is coated with a hardenable resin composition. Upon the hardening of the resin composition, the tail-in portion of the proppant is consolidated into a hard permeable mass having a high compressive strength whereby unconsolidated proppant and formation particulate solids are prevented from flowing out of the fractures with produced fluids. While this technique has been successful, the high costs of the hardenable resin composition and the mixing and proppant coating procedures utilized have contributed to making the cost of the fracturing procedure very high.

Recently, fibers have been mixed with the proppant and the mixture has been deposited in fractures. The fibers function to inhibit the flow-back of proppant by filling channels or void spaces in the proppant pack with fibers thereby inhibiting the movement of proppant and formation particulate solids through the propped fracture. While the presence of the fibers has successfully reduced proppant flow-back in some applications, in others both proppant as well as fibers flow out of the fractures with produced fluids causing damage and operational problems to well production and processing equipment.

Thus, there is a need for improved methods of fracturing and placing proppant in subterranean zones whereby the flow-back of proppant with produced fluids is prevented.

SUMMARY OF THE INVENTION

The present invention provides improved methods of propping a fracture in a subterranean zone with proppant whereby the subsequent flow-back of the proppant with produced fluids is prevented. The methods are basically comprised of the steps of placing a mixture of fibrous bundles and proppant in the fracture while maintaining the fracture open and subsequently allowing the fracture to close on the mixture.

The fibrous bundles utilized in accordance with this invention are each comprised of a plurality of individual fibers which are connected together whereby portions of the fibers are free to flare outwardly. After the fibrous bundles are placed in a fracture with proppant, and fluids are produced from the subterranean zone through the fracture, the fibrous bundles move to voids or channels located within the proppant pack through which both deposited proppant and natural formation particulate solids flow out of the fracture. The movement of the fibrous bundles causes the fibers making up the bundles to flare outwardly which in turn facilitates the formation of permeable barriers by the fibrous bundles in the voids or channels which retard and ultimately prevent the flow-back of proppant and formation particles, but still allow the production of oil and/or gas through the fracture at sufficiently high rates.

It is, therefore, a general object of the present invention to provide improved methods of propping a fracture in a subterranean zone with proppant whereby the subsequent flow-back of the proppant with produced fluids is prevented.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

Figure 1:
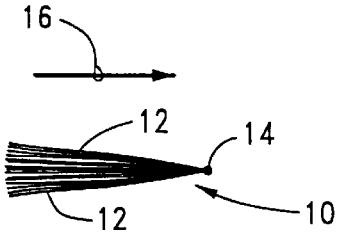
FIG. 1 is a side view of a fibrous bundle useful in accordance with the present invention.

The present invention provides improved methods of fracturing a subterranean zone penetrated by a well bore and propping the fractures with proppant whereby the subsequent flow-back of the proppant along with subterranean formation particulate solids is prevented.

The formation and propping of fractures in a subterranean zone utilizing hydraulic fracturing techniques is well known to those skilled in the art. The hydraulic fracturing process generally involves pumping a viscous fracturing fluid, a portion of which contains suspended proppant, into the subterranean zone by way of the well bore penetrating it at a rate and pressure whereby one or more fractures are created in the zone. The continued pumping of the fracturing fluid extends the fractures in the formation and carries proppant into the fractures. Upon the reduction of the flow of fracturing fluid and pressure exerted on the formation along with the breaking of the viscous fluid into a thin fluid, the proppant is deposited in the fracture and the fractures are prevented from closing by the presence of the proppant therein. That is, after the proppant is placed in the fractures, the fractures are allowed to close on the proppant whereby conductive channels filled with permeable proppant packs are formed through which formation fluids can be produced at sufficiently high rates. However, if the proppant packs include or develop voids or channels therein, proppant flow-back with produced fluids takes place. Such proppant flow-back is highly undesirable in that as the proppant flows through tubular and production equipment it erodes the metal surfaces of the equipment, plugs and erodes valves and other parts of the equipment and generally increases the problems and costs involved in producing wells. In unconsolidated formations where formation particulate solids and fines flow with the produced fluids through the voids and channels in the proppant packs, the problems and costs are compounded.

As mentioned above, various procedures have heretofore been developed and used to prevent proppant and formation particulate solids flow-back from fractured producing formations. A highly successful procedure which has been commonly used involves coating the proppant utilized with a hardenable resin composition and causing the resin composition to harden after the proppant has been placed in a fracture whereby the proppant is consolidated into a hard permeable pack. However, the hardenable resin materials as well as the procedures and equipment required to mix the resin composition and coat the proppant with it involve very high costs which make the fracturing treatment very expensive.

As mentioned, fibers have been mixed with proppant placed in fractures to reduce proppant and formation particulate solids flow-back. However, because the fibers do not readily catch on the fracture faces or proppant material in the fractures, flow-back of the fibers as well as proppant and formation solids often continues to take place.

The improved methods of the present invention are based on the discovery that a mixture of fibrous bundles and proppant when placed in a fracture very effectively prevents proppant and formation solids flow-back. The methods are basically comprised of the steps of placing a mixture of fibrous bundles and proppant in a fracture while maintaining the fracture open and then allowing the fracture to close on the mixture. The fibrous bundles are each comprised of a plurality of fibers connected together whereby portions of the fibers are free to flare outwardly.

Figure 2:
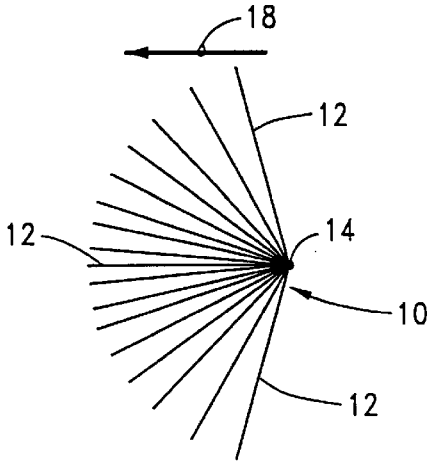
FIG. 2 is a side view of the fibrous bundle of FIG. 1 after the fibers making up the bundle have flared outwardly.

Referring now to the drawings, and particularly to FIGS. 1 and 2, a fibrous bundle useful in accordance with this invention is illustrated and generally designated by the numeral 10. The fibrous bundle 10 is comprised of a plurality of individual fibers 12. The fibers 12 are positioned in the bundle 10 whereby their axes are substantially parallel and they are connected together as shown in FIG. 1, preferably at an end 14 of the bundle 10 such as by fusing, tying or other suitable fiber anchoring means.

The fibers 12 of the bundles 10 can have various cross-sectional shapes such as circular, rectangular or other shape. In addition, the fibers must have a sufficient degree of stiffness to bridge across an opening while permitting flow through the opening. Generally, each of the fibrous bundles 10 is made up of from about 5 to about 200 individual fibers 12 which have lengths in the range of from about 0.33 to about 1 inch and diameters in the range of from about 10 to about 1,000 micrometers. The fibers 12 forming the bundle 10 can be natural organic fibers, synthetic organic fibers, inorganic fibers, glass fibers, carbon fibers, ceramic fibers, metal fibers or mixtures of such fibers.

When the fibrous bundles 10 are suspended along with proppant in a fracturing fluid and the fracturing fluid is pumped into a fracture in the direction indicated by the arrow 16 in FIG. 1, the fibrous bundles generally align themselves in the direction of flow whereby the connected ends 14 of the bundles are in front and the unconnected portions of the fibers 12 trail behind as illustrated in FIG. 1.

After a mixture of the fibrous bundles 10 and proppant has been placed in a fracture, the fracture has been allowed to close on the mixture and fluids are produced through the fracture, if any of the fibrous bundles 10 are moved within the proppant pack with the produced fluids in the direction illustrated by the arrow 18 of FIG. 2, the fibers 12 of at least some of the bundles 10 are flared outwardly as shown in FIG. 2. The outward flaring of the fibers 12 causes the fibrous bundles 10 to catch on the fracture faces and proppant therein whereby a permeable fibrous barrier is formed in voids or channels in the proppant pack as will be described further hereinbelow.

Figure 3:
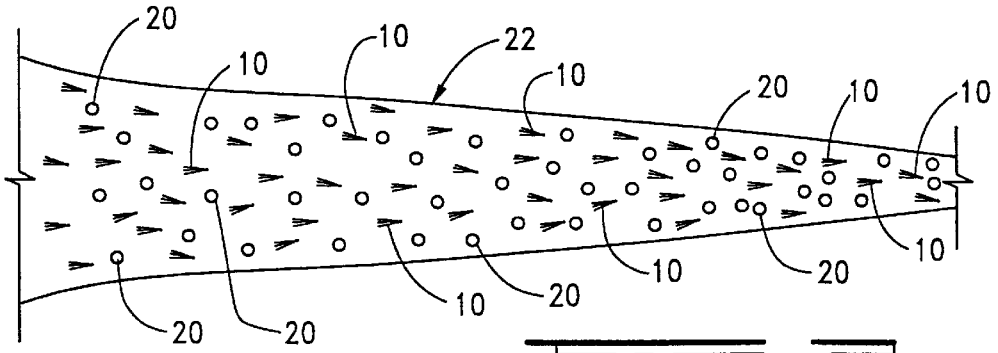
FIG. 3 is a side schematic view of a portion of a fracture formed in a subterranean zone during the placement of a mixture of fibrous bundles and proppant therein.

The improved methods of the present invention of fracturing a subterranean zone penetrated by a well bore and placing proppant therein whereby the flow-back of proppant and formation particulate solids with produced fluids from the subterranean zone is prevented are comprised of the following steps. A mixture of fibrous bundles 10 and a proppant such as sand is suspended in a portion of a viscous fracturing fluid. The fracturing fluid is pumped by way of the well bore into the subterranean zone at a sufficient rate and pressure to fracture the zone. Thereafter, the pumping of the fracturing fluid is continued whereby the fracture or fractures formed are extended and the mixture of fibrous bundles 10 and proppant 20 is placed in each of the fractures 22 as illustrated in FIG. 3.

Figure 4:
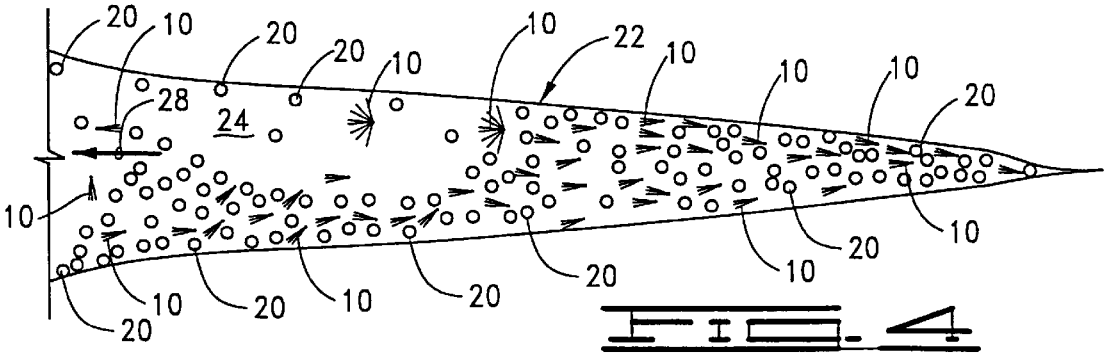
FIG. 4 is a view of the fracture of FIG. 3 after the fracture has been allowed to close on the fibrous bundles and proppant and proppant flow-back with produced fluids through a void in the proppant pack is taking place.
Figure 5:
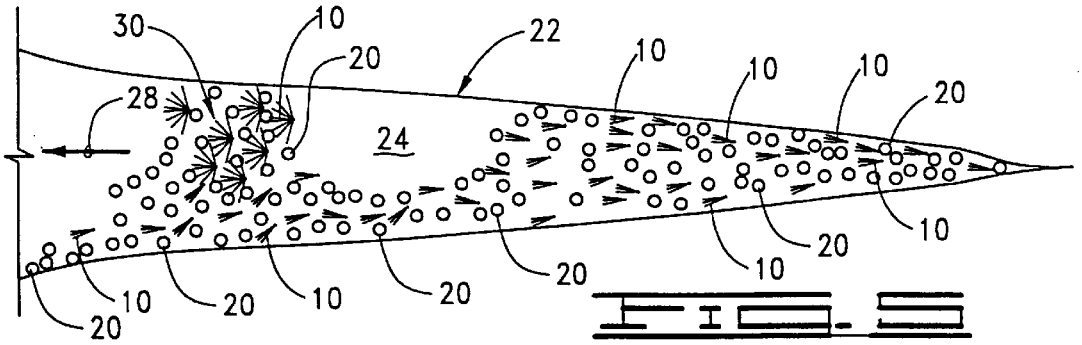
FIG. 5 is a view of the fracture of FIG. 4 after fibrous bundles in the proppant pack have formed a permeable barrier in the void and terminated the proppant flow-back from the fracture.

Once the mixture of fibrous bundles 10 and proppant 20 is placed, the fracture 22 is allowed to close on the mixture as shown in FIG. 4 by the termination of the fracturing fluid flow and pressure exerted on the formation along with the breaking of the fracturing fluid into a thin fluid. If a void or flow channel 24 occurs or develops in the proppant pack 26 formed in the fracture 22 as shown in FIG. 4, proppant 20 and fibrous bundles 10 flow through the void or channel 24 and out of the fracture 22 with produced fluids in the direction indicated by the arrow 28 of FIG. 4. As mentioned, when the fibrous bundles 10 are moved by the flow of produced fluids, the fibers 12 of at least some of the bundles flare outwardly as shown in FIG. 4. As the outwardly flared fibrous bundles 10 move through the void 24, they catch on the fracture faces and/or proppant 20 in the fracture 22 and form a permeable barrier 30 in the void 24 which closes it and prevents continued proppant flow-back as shown in FIG. 5.

Fracturing fluids which can be utilized in accordance with the present invention include gelled water or oil base liquids, foams and emulsions. The foams utilized have generally been comprised of water based liquids containing one or more foaming agents foamed with a gas such as nitrogen or air. Emulsions formed with two or more immiscible liquids have also been utilized. A particularly useful emulsion for carrying out formation fracturing procedures is comprised of a water based liquid and a liquified, normally gaseous fluid such as carbon dioxide. Upon pressure release, the liquified gaseous fluid vaporizes and rapidly flows out of the formation.

The most common fracturing fluid utilized heretofore which is generally preferred for use in accordance with this invention is comprised of water, a gelling agent for gelling the water and increasing its viscosity, and optionally, a crosslinking agent for crosslinking the gel and further increasing the viscosity of the fluid. The increased viscosity of the gelled or gelled and crosslinked fracturing fluid reduces fluid loss and allows the fracturing fluid to transport significant quantities of suspended fibrous bundles and proppant into the created fractures.

The water utilized to form the fracturing fluids used in accordance with the methods of this invention can be fresh water, salt water, brine or any other aqueous liquid which does not adversely react other components of the fracturing fluids.

A variety of gelling agents can be utilized including hydratible polymers which contain one or more of the functional groups such as hydroxyl, cis-hydroxyl, carboxyl, sulfate, sulfonate, amino or amide. Particularly useful such polymers are polysaccharides and derivatives thereof which contain one or more of the monosaccharide units galactose, mannose, glucoside, glucose, xylose, arabinose, fructose, glucuronic acid or pyranosyl sulfate. Natural hydratable polymers containing the foregoing functional groups and units include guar gum and derivatives thereof, locust bean gum, tara, konjak, tamarind, starch, cellulose and derivatives thereof, karaya, xanthan, tragacanth and carrageenan. Hydratible synthetic polymers and copolymers which contain the above mentioned functional groups and which have been utilized heretofore include polyacrylate, polymethacrylate, polyacrylamide, maleic anhydride, methylvinyl ether polymers, polyvinyl alcohol and polyvinylpyrrolidone.

Examples of crosslinking agents which can be utilized to further increase the viscosity of the gelled fracturing fluid are multivalent metal salts or other compounds which are capable of releasing multivalent metal ions in an aqueous solution. Examples of the multivalent metal ions are chromium, zirconium, antimony, titanium, iron (ferrous or ferric), zinc or aluminum. The above described gelled or gelled and crosslinked fracturing fluid can also include gel breakers such as those of the enzyme type, the oxidizing type or the acid buffer type which are well known to those skilled in the art. The gel breakers cause the viscous fracturing fluids to revert to thin fluids that can be produced back to the surface after they have been used to create and prop fractures in a subterranean zone.

The mixture of fibrous bundles and proppant utilized in accordance with this invention is suspended in a portion of the viscous fracturing fluid so that the mixture is placed in the formed fractures in a subterranean zone. Thereafter, the fracturing fluid flow and pressure exerted on the fractured subterranean zone are terminated whereby the fractures are allowed to close on the mixture. The suspension of the mixture of fibrous bundles and proppant in the fracturing fluid can be accomplished by utilizing conventional batch mixing techniques to mix and suspend the bundles and proppant, or one or both of the bundles and proppant can be injected into the fracturing fluid on-the-fly.

The proppant utilized is of a size such that formation particulate solids which migrate with produced fluids are prevented from flowing through the fractures. Various kinds of particulate materials can be utilized as proppant including sand, bauxite, ceramic materials, glass materials, "TEFLON™" materials and the like. Generally the particulate material used has a particle size in the range of from about 2 to about 400 mesh, U.S. Sieve Series. The preferred particulate material is sand having a particle size in the range of from about 10 to about 70 mesh, U.S. Sieve Series. Preferred sand particle size distribution ranges are one or more of 10–20 mesh, 20–40 mesh, 40–60 mesh or 50–70 mesh, depending on the particular size and distribution of the formation solids to be screened out by the proppant.

As will be understood by those skilled in the art, the fracturing fluid utilized in accordance with this invention can include one or more of a variety of well known additives such as gel stabilizers, fluid loss control additives, clay swelling reducing additives (clay stabilizers), friction reducing additives, bactericides and the like.

Thus, the present invention is well adapted to carry out the objects and attain the benefits and advantages mentioned as well as those which are inherent therein. While numerous changes can be made by those skilled in the art, such changes are encompassed within the spirit of this invention as defined by the appended claims.

What is claimed is:

1. An improved method of propping a fracture in a subterranean zone with proppant whereby the subsequent flow-back of the proppant with produced fluids is prevented comprising the steps of:

placing a mixture of fibrous bundles and said proppant in said fracture while maintaining said fracture open, said fibrous bundles each being comprised of a plurality of parallel fibers connected together at an end whereby portions of said fibers are free to flare outwardly; and allowing said fracture to close on said mixture of fibrous bundles and proppant.

2. The method of claim 1 wherein said fibrous bundles are formed of fibers selected from the group of natural organic fibers, synthetic organic fibers, inorganic fibers, glass fibers, carbon fibers, ceramic fibers, metal fibers and mixtures thereof.

3. The method of claim 1 wherein said proppant is a particulate material selected from the group of sand, bauxite, ceramics, glass, plastics, resins and mixtures thereof.

4. The method of claim 1 wherein each of said fibrous bundles are formed of from about 5 to about 200 fibers having lengths in the range of from about 0.33 to about 1 inch and diameters in the range of from about 10 to about 1,000 micrometers.

5. The method of claim 1 wherein said proppant is sand having a particle size in the range of from about 10 to about 70 mesh, U.S. Sieve Series.

6. An improved method of fracturing a subterranean zone penetrated by a well bore and placing proppant therein whereby flow-back of proppant and formation particulate solids from the subterranean zone is prevented comprising the steps of:

pumping a fracturing fluid by way of said well bore into said subterranean zone at a sufficient rate and pressure to form at least one fracture in said zone;

placing a mixture of fibrous bundles and said proppant in said fracture while maintaining said fracture open, said fibrous bundles each being comprised of a plurality of parallel fibers connected together at an end whereby portions of said fibers are free to flare outwardly; and allowing said fracture to close on said mixture of fibrous bundles and proppant.

7. The method of claim 6 wherein said mixture of said fibrous bundles and proppant is suspended in a portion of said fracturing fluid and is placed in said fracture thereby.

8. The method of claim 6 wherein said fibrous bundles are formed of fibers selected from the group of natural organic fibers, synthetic organic fibers, inorganic fibers, glass fibers, carbon fibers, ceramic fibers, metal fibers and mixtures thereof.

9. The method of claim 6 wherein said proppant is a particulate material selected from the group of sand, bauxite, ceramics, glass, plastics, resins and mixtures thereof.

10. The method of claim 6 wherein each of said fibrous bundles are formed of from about 5 to about 200 fibers having lengths in the range of from about 0.33 to about 1 inch and diameters in the range of from about 10 to about 1,000 micrometers.

11. The method of claim 6 wherein said proppant is sand having a particle size in the range of from about 10 to about 70 mesh, U.S. Sieve Series.

12. An improved method of fracturing a subterranean zone penetrated by a well bore and placing proppant therein whereby flow-back of proppant and formation particulate solids from the subterranean zone is prevented comprising the steps of:

suspending a mixture of fibrous bundles and said proppant in a portion of a fracturing fluid, said fibrous bundles each being comprised of a plurality of parallel fibers connected together at one end whereby the non-connected ends of said fibers are free to flare outwardly; and pumping said fracturing fluid into said subterranean zone at a sufficient rate and pressure to form at least one fracture in said zone;

placing said mixture of fibrous bundles and proppant in said fracture while maintaining said fracture open; and allowing said fracture to close on said mixture of fibrous bundles and proppant.

13. The method of claim 12 wherein said fibrous bundles are formed of fibers selected from the group of natural organic fibers, synthetic organic fibers, inorganic fibers, glass fibers, carbon fibers, ceramic fibers, metal fibers and mixtures thereof.

14. The method of claim 13 wherein said proppant is a particulate material selected from the group of sand, bauxite, ceramics, glass, plastics, resins and mixtures thereof.

15. The method of claim 14 wherein each of said fibrous bundles are formed of from about 5 to about 200 fibers having lengths in the range of from about 0.33 to about 1 inch and diameters in the range of from about 10 to about 1,000 micrometers.

16. The method of claim 15 wherein said proppant is sand having a particle size in the range of from about 10 to about 70 mesh, U.S. Sieve Series.

17. The method of claim 12 wherein said fibrous bundles are formed of synthetic organic fibers and are connected at one end by the fusion of said fibers together.

18. The method of claim 17 wherein each of said fibrous bundles are formed of from about 5 to about 200 fibers having lengths in the range of from about 0.33 to about 1 inch and diameters in the range of from about 10 to about 1,000 micrometers.

19. The method of claim 18 wherein said proppant is sand ing a particle size in the range of from about 10 to about mesh, U.S. Sieve Series.

20. The method of claim 19 wherein said fracturing fluid comprised of an aqueous fluid having a hydratable polymer solved therein.

* * * * *